United States Patent [19]

Garner

[11] 4,381,090

[45] Apr. 26, 1983

[54] MISSILE STEERING SYSTEM USING A SEGMENTED TARGET DETECTOR AND STEERING BY ROLL AND PITCH MANEUVERS

[75] Inventor: William G. Garner, Grant, Ala.

[73] Assignee: The United States of America as represented by the Secretary of the Army, Washington, D.C.

[21] Appl. No.: 687,924

[22] Filed: Nov. 27, 1967

[51] Int. Cl.[3] ..... F41G 7/22; F42B 15/02

[52] U.S. Cl. ..... 244/3.16

[58] Field of Search ..... 244/3.13, 3.16; 250/203; 102/3

[56] References Cited

U.S. PATENT DOCUMENTS

| | | | |
|---|---|---|---|
| 2,403,387 | 7/1946 | McLennan | 244/3.16 U X |
| 2,520,433 | 8/1950 | Robinson | 244/3.16 |
| 2,588,382 | 3/1952 | Hammond | 244/3.16 X |
| 2,994,270 | 8/1961 | Hull | 244/3.13 |
| 3,128,061 | 4/1964 | Chew | 244/3.16 |
| 3,233,848 | 2/1966 | Byrne | 244/3.16 X |

*Primary Examiner*—Charles T. Jordan

*Attorney, Agent, or Firm*—Nathan Edelberg; Robert P. Gibson; Aubrey J. Dunn

[57] ABSTRACT

A missile control and guidance system employing a combination of generally vertically disposed ailerons and generally horizontally disposed elevators. In order to make a horizontal turn, a combination of aileron and elevator deflections is used, to cause the missile to make a "blanked" turn. The ailerons and elevators are controlled by servos activated by a logic circuit. The logic circuit is connected to a segmented target detector. The missile will maneuver depending on which of the segments of the detector "sees" a target.

3 Claims, 1 Drawing Figure

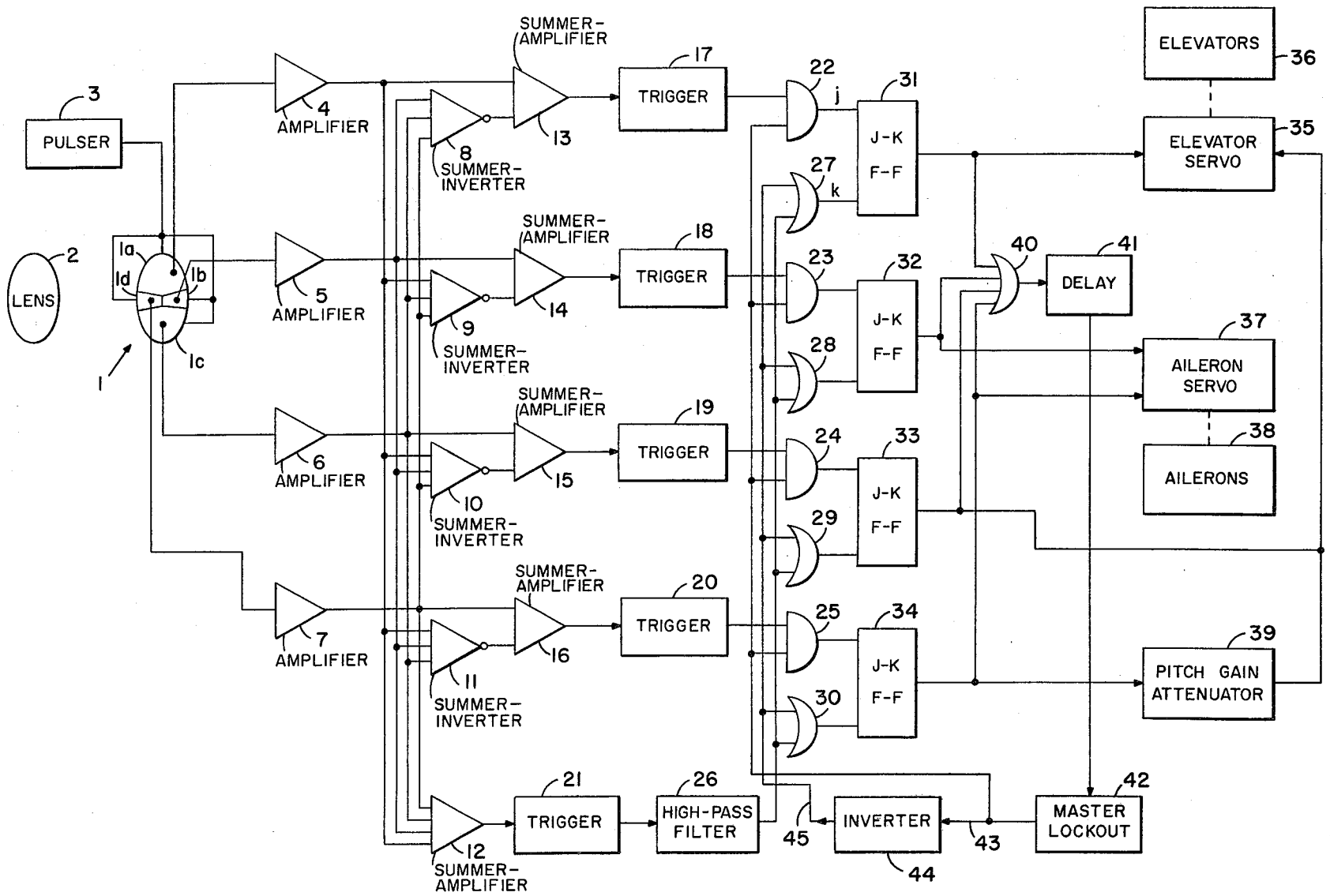
ELEVATORS
36
ELEVATOR SERVO
35
AILERON SERVO
37
AILERONS
38
PITCH GAIN ATTENUATOR
39
DELAY
41
MASTER LOCKOUT
42
40
43
J-K F-F
31
32
33
34
INVERTER
44
22
27
23
28
24
29
25
30
45
TRIGGER
17
18
19
20
HIGH-PASS FILTER
26
21
SUMMER-AMPLIFIER
13
14
15
16
12
SUMMER-INVERTER
8
9
10
11
AMPLIFIER
4
5
6
7
1a
1b
1c
1d
1
PULSER
3
LENS
2

MISSILE STEERING SYSTEM USING A SEGMENTED TARGET DETECTOR AND STEERING BY ROLL AND PITCH MANEUVERS

DEDICATORY CLAUSE

The invention described herein may be manufactured, used, and licensed by or for the Government for governmental purposes without the payment to me of any royalty thereon.

BACKGROUND OF THE INVENTION

This invention is in the field of steering control systems for guided missiles.

There are many types of guided missiles, with different respective steering means. Of the non-roll-stabalized missiles, there is at least one common guidance technique, namely, the use of generally vertical rudders and generally horizontal elevators. This technique is used whether the missile uses canard control, wing control, tail control, wingless tail control, or tailless control. In order to make a turn in a horizontal plane with the known missiles, a rudder (or its equivalent) is deflected in the proper direction. This makes for a very simple control system, but has the disadvantage that a "skidding" turn is made. In a conventional aircraft, a turn is usually made by "banking", with the use of a combination of ailerons and elevators, rather than merely using the rudder. A much tighter turn can be executed, using ailerons and elevators, with less overshoot, and without skidding, than could be performed by using the rudder. On some aircraft the rudder and the ailerons are tied together.

The invention is a system which allows a missile, using a particular target detecting means, to make a "banked" turn toward that target.

An object of the invention is to provide an improved missile guidance system.

Another object is to provide a missile guidance system employing ailerons and elevators for guidance of the missile.

Yet another object is to provide a missile using a segmented target detector, with the missile using aileron and elevator control surfaces.

SUMMARY OF THE INVENTION

This invention is a novel missile control system employing a segmented target seeker, and means for guiding the missile toward the target using ailerons and elevators for control surfaces. The system allows a missile to make tighter turns when pursuing a target. The system is also simpler and less expensive than known missile control systems.

BRIEF DESCRIPTION OF THE DRAWING

The single drawing FIGURE is a schematic diagram of the invention.

DESCRIPTION OF THE PREFERRED EMBODIMENT

Referring to the drawing, a segmented target detector is generally designated 1, and consists of four segments designated 1*a*, 1*b*, 1*c*, and 1*d*. Mounted adjacent detector 1 is a lens 2, which focusses an image of a target (not shown) on detector 1. Detector 1 is responsive to visible light, or infrared images of targets. Detector 1 may be photo-voltaic or photo-resistive, but in either event, is "blinked" off and on by a pulser 3, which pulser would be a connection to circuit ground for a photo-voltaic detector, or a voltage source for a photo-resistive detector. Connected to each of the segments of 1 is an amplifier, respectively designated 4, 5, 6 and 7. It should be noted that the segments of detector 1 are not equal in size, but that segments 1*a* and 1*c* are larger than segments 1*b* and 1*d*, for reason to be explained below.

Four summer-inverters 8, 9, 10 and 11 are provided. The output of amplifier 4 is connected to one input of each of 9–11; the output of amplifier 5 is connected to an input of each of 8, 10, and 11; the output of amplifier 6 is connected to an input of each of 8, 9, and 11; and the output of amplifier 7 is connected to an input of each of 8–10. The output of each of amplifiers 4–7 is also connected to an input of an algebraic summer-amplifier, designated 12. The output of each of amplifiers 4–7 is also connected to a respective input of algebraic summer-amplifiers 13, 14, 15, and 16. Also connected as inputs of 13–16 are respective outputs of summer-inverters 8–11. The output of each of 13–16 is connected to a respective input of triggers 17, 18, 19, and 20, which triggers may be Schmitt triggers or the equivalent. The output of summer-amplifier 12 is also connected to a trigger 21, similar to triggers 17–20. The outputs of triggers 17–20 are connected to respective inputs of AND gates 22, 23, 24, and 25; which gates have another input that will be described below. The output of trigger 21 serves as an input to a high-pass filter (26). The output of 26 is applied to one input of OR gates 27, 28, 29, and 30. The other input to gates 27–30 will be explained below. The outputs of AND gates 22–25 are connected to respective inputs of J-K flip-flops 31, 32, 33, and 34. Connected to the other inputs of 31–34 are the outputs of OR gates 27–30. The AND gates are connected to the j inputs, and the OR gates are connected to the k inputs of the flip-flops. Each of the flip-flops has an output which is in a high state when its respective flip-flop is in a set condition, and is in a low or zero state when its respective flip-flop is in a reset condition with the j and k inputs corresponding to set and reset. The outputs of flip-flops 31 and 33 are connected to a bidirectional elevator servo 35. When one of flip-flops 31 or 33 has its output in a high state, the servo activates elevators 36 full in one direction, and conversely for the other flip-flop. Flip-flops 32 and 34 are connected to aileron servo 37. When the output of one of flip-flops 32 or 34 is in its high state, servo 37 fully activates ailerons 38 in one differential position, and conversely for the other flip-flop. The output of flip-flop 34 is also connected to a pitch-gain attenuator 39. When the output of 34 is in a high state, the amplitude thereof is attenuated by 39, and allows a partial activation of the elevators, in the same direction that the output of flip-flop 33 activates the elevators. Attenuator 39 may be a voltage divider or the like. The partial activation of the elevators when the ailerons are activated in one direction allows additional lift to be generated by the elevators, to maintain level flight of the missile as it makes an aileron-initiated horizontal turn. The elevator may take the form of generally horizontal pivoted fins, but the ailerons may be only differentially operated trailing edges of generally vertical fixed fins, since yaw is not intended as a basic guiding maneuver in the invention.

The output of each of flip-flops 31–34 is additionally connected as an input to an OR gate 40. The output of 40 is passed thru a delay means (41) to a master lockout (42). Delay means 41 may take any of the well known means, such as a delay line. Master lockout 42 is a one-shot multivibrator or the like, and provides an output at 43, connected to an inverter 44. When the multivibrator of 42 is in its quiescent state, it has a low output at 43, and when it is in its unstable state, has a high output 43. Inverter 44 has a high output at 45 when the output at 43 is low, and conversely. Output 43 is also connected to an input of each of AND gates 22–25. Output 45 is connected as an input of each of OR gates 27–30. In the event that master lockout 42 has a low output, inverter 45 will have a high output, and will apply this high output to inputs of each of OR gates 27–30. These gates will cause all of flip-flops 31–34 to revert to a condition so that their outputs are low state, if they are not already in such a condition. OR gates 27–30 are able to control flip-flops 31–34, regardless of the states of AND gates 22–25. Master lockout 42 will normally have a high output, as long as detector 1 gives a sufficient output. If detector 1 should momentarily lose signal of a target, its output will be insufficient to cause triggering of any of triggers 17–20, and AND gates 22–25 will have only one input, and will close. Respective flip-flops 31–34 will then revert to their reset conditions, and will have low outputs. These low outputs, connected to OR gate 40, will cause a low output from 40. After a time delay, the output from delay 41 will go to a low state, and master lockout 42 will change its output at 43 from high to low state. Inverter 44 will then provide a high output at 45, and OR gates 27–30 will have high outputs, and flip-flops 31–34 will be held in a reset condition, even if detector 1 should eventually have a proper output. AND gates 22–25 will be unable to reopen, since one of their inputs comes from master lockout 42.

Summer-amplifier 12 and trigger 21 insure that none of flip-flops 31–34 have high outputs unless a proper target is in sight. The target image on detector 1 excites at least one of segments 1*a*–1*d* and causes a corresponding output thru its respective amplifier (4–7), summer-amplifier (13–16), and trigger (17–20). For the sake of example, let it be assumed that segment 1*a* has a target image focussed thereon, and has an output thru amplifier 4 to summer-amplifier 13. If none of the other segments have images focussed on them, their outputs will be very low, compared to the output of 1*a*. Segments 1*b*–1*d* are connected to summer-inverter 8. If it is assumed that segment 1*b* has a high output at the same time as 1*a*, amplifier 5 will provide a high input to summer-inverters 8, 10, and 11. The output of 8 will add algebraically in 13 to the output of amplifier 4. If the inputs to 13 are nearly the same, or are equal, 17 will not be triggered. If two or three of the segments other than 1*a* had outputs at the same time as 1*a*, their outputs would be summed, and if of sufficient amplitude, would have the same effect at 13 as the above described high output from 1*b*. In other words, the missile would not attempt control maneuvers with more than one target in sight. High-pass filter 26 filters out low-frequency noise.

The sectors of detector 1 have been shown of different sizes, since sectors 1*b* and 1*d* are intended as roll controllers, and it is desired to limit the amount of roll response, in order to cut down the necessary servo power for roll. Sectors 1*b* and 1*d* may each subtend only 2° along the pitch axis.

Sectors 1*a* and 1*c* are used for pitch, and because of large pitch errors, a large drive value toward zero error is used.

In a missile using a quadrant detector having equal size segments, yaw and pitch are the basic maneuvers, but with the present detector, roll and pitch are the basic maneuvers.

Although yaw is not intended as a basic maneuver in the invention, favorable yaw could be designed into the system using known aerodynamic techniques.

Lens 2 may provide a defocussed image on detector 1, in order that there will be no large change in apparent target image size as the missile approaches the target.

Pulser 3 is necessary for passive targets, in order that the inventive system may use digital techniques. For a target illuminated by pulsing exterior means, pulser 3 would not be necessary.

Summer-inverters 8–11 may be summing circuits with a single stage current amplifier as an inverter.

While a specific embodiment of the invention has been described, other embodiments may be obvious to one skilled in the art, in light of this disclosure. For example, thrust jets may be used instead of elevators and ailerons.

I claim:

1. A guidance system for a missile having deflectable steering surfaces including: segmented target detecting means comprising first and second roll segments, and first and second pitch segments; wherein said roll segments subtend small angular displacements with respect to said pitch segments, and said roll segments and said pitch segments are respectively centered around two orthogonal axes; connecting means between said target detecting means and a logic means; and control means for said steering surfaces, said control means connected to said logic means.

2. The system as defined in claim 1 wherein said connecting means includes an amplifier connected to each of said segments; respective first summing means connected to each of said amplifiers; and summer-inverter means connected to ones of said amplifier means and to said summing means; said logic means includes respective first trigger means connected to respective ones of said summer means; AND gates each having two inputs and an output, with said trigger means connected to one of said inputs; respective flip-flops, each having two inputs and an output, with the output of said AND gates connected to respective first inputs of said flip-flops; a first OR gate having plural inputs and an output, with each of the outputs of said flip-flops connected to a respective input of said OR gate; delay means connected to said output of said output of said OR gate; master lockout means connected to said delay means; inverter means, said lockout means having an output connected to said inverter means; and a plurality of OR gates each having two inputs and an output, said inverter means connected to an input of said OR gates; said connecting means further including second summing means having plural inputs and an output, with each of said amplifiers connected to a respective input of said second summing means; second trigger means having an input and an output, with said input connected to said output of said second summer means; and a filter having an input and an output, with said input connected to said output of said second trigger means, and said output connected to the other input of each of said plurality of OR gates; said output of said master lockout means connected to the other input of each of said AND gates; said control means including two bidirectional servo means each having two inputs and being mechanically coupled to respective steering surfaces, said inputs being connected to respective outputs of said flip-flops; and an attenuator connected between one of said outputs of said flip-flops and one of the inputs of one of said servos.

3. The system as defined in claim 2 further including means connected to said detecting means for periodically energizing said detecting means.

* * * * *